US009410229B2

(12) United States Patent
Brooks et al.

(10) Patent No.: US 9,410,229 B2
(45) Date of Patent: Aug. 9, 2016

(54) HIGH STRENGTH ALUMINUM ALLOYS AND PROCESS FOR MAKING THE SAME

(75) Inventors: Charles E. Brooks, Casa Grande, AZ (US); Ralph C. Dorward, Escalon, CA (US); Ray D. Parkinson, Livermore, CA (US); Rob A. Matuska, Heath, OH (US); Mory Shaarbaf, Jackson, TN (US)

(73) Assignee: Kaiser Aluminum Fabricated Products, LLC, Foothill Ranch, CA (US)

( * ) Notice: Subject to any disclaimer, the term of this patent is extended or adjusted under 35 U.S.C. 154(b) by 1239 days.

(21) Appl. No.: 12/980,874

(22) Filed: Dec. 29, 2010

(65) Prior Publication Data

US 2011/0150696 A1 Jun. 23, 2011

Related U.S. Application Data

(60) Continuation-in-part of application No. 12/591,956, filed on Dec. 4, 2009, now abandoned, which is a division of application No. 11/087,733, filed on Mar. 24, 2005, now abandoned.

(51) Int. Cl.
*C22C 21/10* (2006.01)

(52) U.S. Cl.
CPC ..... *C22C 21/10* (2013.01)

(58) Field of Classification Search
CPC ..... C22C 21/10; C22F 1/053
USPC ..... 148/417; 420/532
See application file for complete search history.

(56) References Cited

U.S. PATENT DOCUMENTS

| | | | | |
|---|---|---|---|---|
| 5,560,789 | A | 10/1996 | Sainfort | |
| 6,557,289 | B2 | 5/2003 | Stall | |
| 6,627,012 | B1 * | 9/2003 | Tack et al. | 148/690 |
| 2002/0162609 | A1 | 11/2002 | Warner | |
| 2003/0219353 | A1 * | 11/2003 | Warner et al. | 420/532 |
| 2005/0034794 | A1 * | 2/2005 | Benedictus et al. | 148/552 |
| 2005/0236075 | A1 | 10/2005 | Gheorghe | |
| 2006/0174980 | A1 * | 8/2006 | Benedictus et al. | 148/552 |

* cited by examiner

*Primary Examiner* — Roy King
*Assistant Examiner* — Janelle Morillo
(74) *Attorney, Agent, or Firm* — Yancy IP Law, PLLC

(57) ABSTRACT

High strength aluminum alloys based on the Al—Zn—Mg—Cu alloy system preferably include high levels of zinc and copper, but modest levels of magnesium, to provide increased tensile strength without sacrificing toughness. Preferred ranges of the elements include by weight, 8.5-10.5% Zn, 1.4-1.85% Mg, 2.25-3.0% Cu and at least one element from the group Zr, V, or Hf not exceeding about 0.5%, the balance substantially aluminum and incidental impurities. In addition, small amounts of scandium (0.05-0.30%) are also preferably employed to prevent recrystallization. During formation of the alloys, homogenization, solution heat treating and artificial aging processes are preferably employed.

20 Claims, 5 Drawing Sheets

Fig 1. Effect of Composition on T6 Strength
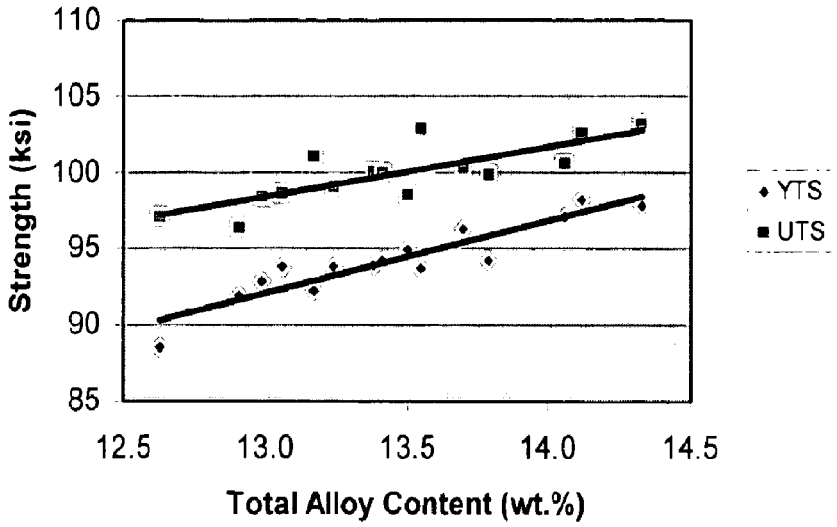
Fig 2. Effect of Mg+Cu content on fracture toughness
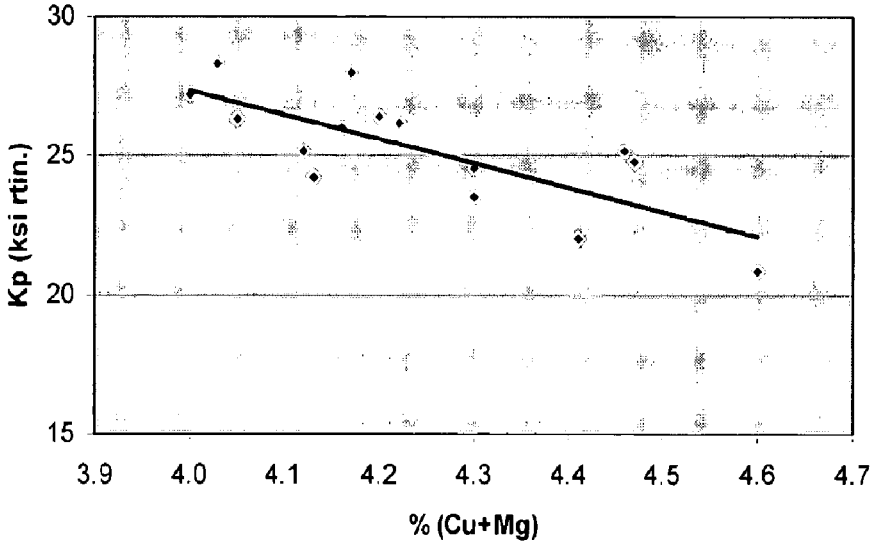

Fig 3. Phase relationships for Al-9% Zn-Mg-Cu system at 885F
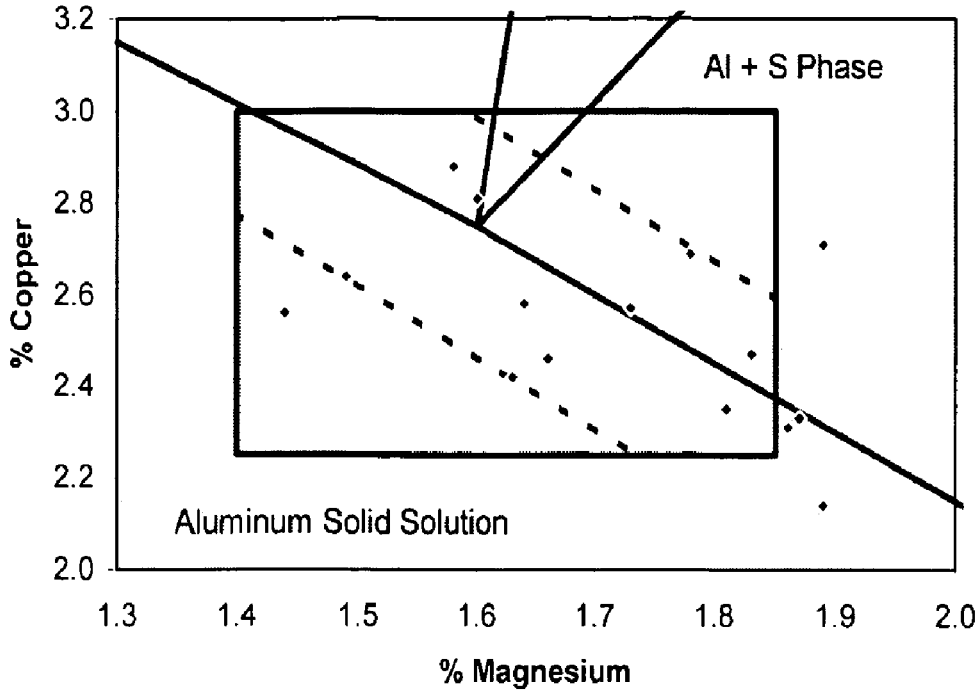
Fig 4. Effect of Mg/Cu ratio on fracture toughness
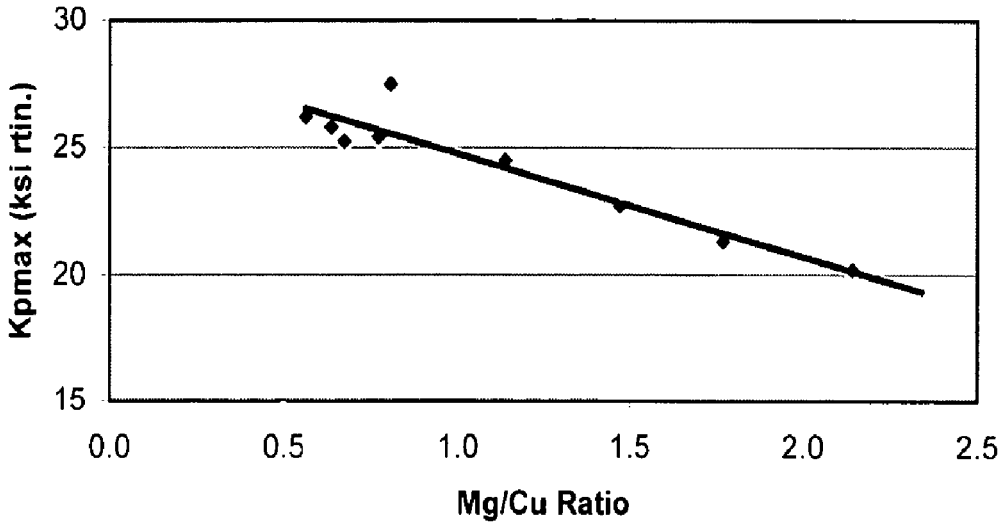

Fig 5. Efect of Heating Rate on Scond Phase in AA7068
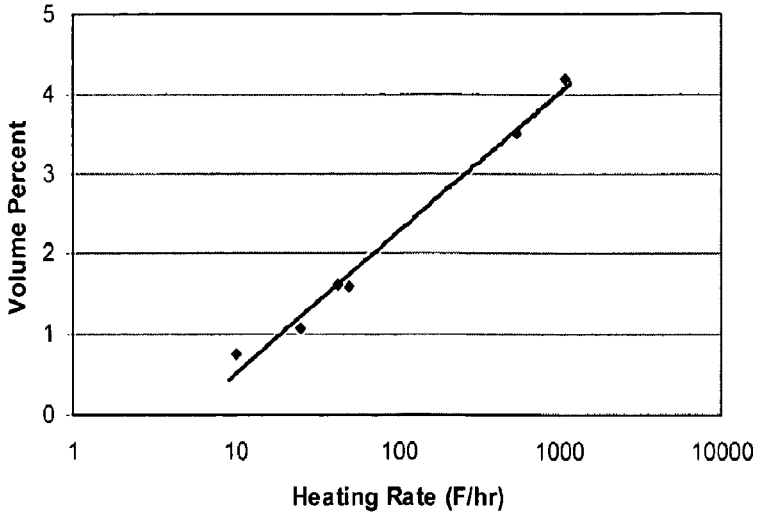
Fig 6. Effect of scandium on strength of Al-8%Zn-2.2%Mg-1.9%Cu alloy
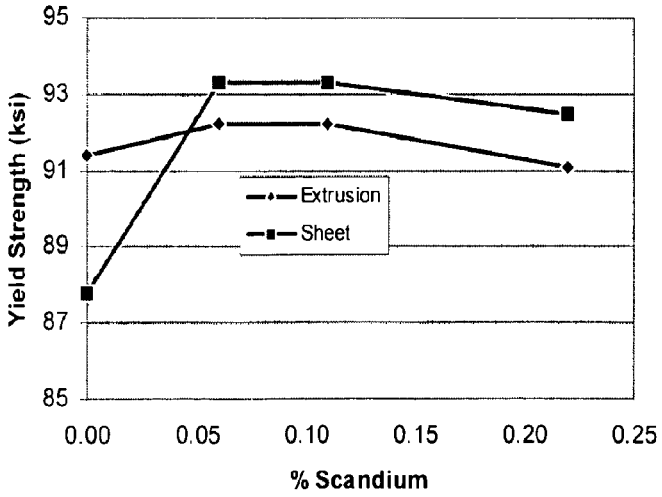

HIGH STRENGTH ALUMINUM ALLOYS AND PROCESS FOR MAKING THE SAME

CROSS REFERENCE TO RELATED APPLICATIONS

This application contains subject matter that is related to the subject matter set forth in U.S. application Ser. No. 10/829,391, which was filed on Apr. 22, 2004.

This application is a continuation-in-part application of U.S. patent application Ser. No. 12/591,956 filed on Dec. 4, 2009, which is a divisional application of U.S. patent application Ser. No. 11/087,733 filed on Mar. 24, 2005, the entire contents of each application are expressly incorporated herein by reference.

BACKGROUND OF THE INVENTION

1. Field of the Invention

The present invention relates, in general, to a high strength aluminum alloy based on the Al—Zn—Mg—Cu alloy system and a process for forming the same. Although not limited thereto, the alloys are particularly suited for use in sporting goods and aerospace applications.

2. Description of the Background Art

The highest strength aluminum alloys known at this time are based on the aluminum-zinc-magnesium-copper system. Commercial high-strength alloys currently being produced include AA7055 (nominally 8% Zn-2% Mg-2.2% Cu-0.10% Zr), AA7068 (nominally 7.8% Zn-2.5% Mg-2.0% Cu-0.10% Zr) and a Kaiser Aluminum alloy designated K749 (nominally 8% Zn-2.2% Mg-1.8% Cu-0.14% Zr). From the published phase relationships at 860° F. for an alloy containing 8% Zn, one can note that K749 is near a phase boundary, while the other two alloys are in multiple phase fields. In the latter case all the alloying elements are not in solid solution at 860° F., and are not only unavailable for age hardening, but the undissolved phases remaining after heat treatment detract from toughness. Although solution heat treating at a higher temperature than 860° F. will dissolve more of the solute, care has to be taken to ensure that the alloy does not undergo eutectic melting, which is a common problem in commercially cast alloys that have locally enriched regions as a result of microsegregation that occurred during casting.

There is a need in many applications, such as sporting goods and aerospace applications, for even stronger alloys based on the aluminum-zinc-magnesium-copper system that do not sacrifice toughness. However, this requirement presents a problem because, in general, as the tensile strength of an aluminum alloy is increased, its toughness decreases.

SUMMARY OF THE INVENTION

The present invention addresses the foregoing need in a number of ways. More particularly, there are three distinct avenues for increasing an alloy's strength while maintaining its toughness: rich alloy chemistries; processing to maximize alloying effectiveness; and preventing recrystallization. Rich alloys provide more solute, which is potentially available for age hardening to higher strength levels; effective processing ensures that the solute is available for strengthening and not out of solution as second phases, which detract from fracture toughness; and maintaining an unrecrystallized microstructure optimizes both strength and toughness.

To provide increased tensile strength without sacrificing toughness through the use of rich chemistries, the present invention comprises aluminum alloys based on the Al—Zn—Mg—Cu alloy system that preferably include high levels of zinc and copper, but modest levels of magnesium. As an option, small amounts of scandium can also be employed to prevent recrystallization. Each of the alloys preferably includes at least 8.5% Zn and 2.25% Cu by weight. Higher levels of each of these elements up to about 10.5% Zn and 3.0% Cu can be used. However, modestly lower amounts of Mg (max 1.85%) are preferably used to allow higher levels of the Cu. The preferred ranges of all elements in the alloys include by weight, 8.5-10.5% Zn, 1.4-1.85% Mg, 2.25-3.0% Cu, and at least one element from the group Zr, V, or Hf not exceeding about 0.5%, the balance substantially aluminum and incidental impurities. In the preferred embodiments, 0.05-0.30% Sc is also included in the alloys to prevent recrystallization. Additionally, it has been found that toughness decreases as the total weight percentage of magnesium and copper increases. Experiments have established that the ideal range of these two elements be between 4.1 and 4.5% combined. Still further, the total weight percent of Zn, Cu and Mg is ideally between 13.0 and 14.5%.

To maximize alloying effectiveness during formation of the alloys, a homogenization process is preferably employed after alloy ingot casting in which a slow rate of temperature increase is employed as the alloy is heated as near as possible to its melting temperature. In particular, for the last 20-30° F. below the melting temperature, the rate of increase is limited to 20° F./hr. or less to minimize the amount of low melting point eutectic phases and thereby further enhance fracture toughness of the alloy. Once the ingot is formed into finished shape using extrusion and rolling steps, for example, the product is preferably solution heat treated at 870 to 900° F. and then artificially aged. The aging process can be carried out by exposing the product to a one, two or three step heat treatment process. In the first step, the product is exposed to a temperature range of 175-310° F. for 3 to 30 hours. In the optional second step, the first step is followed by heating at 310 to 360° F. for 2 to 24 hours. Finally, in the third optional step, the product is heated at 175 to 300° F. for 1 to 30 hours. As a still further option, the second and third aging steps can be used without the first aging step.

The foregoing alloys and processing operations enhance the properties of the Al—Zn—Mg—Cu alloy system, such that they can be more effectively employed in numerous applications. Specific products or items in which the subject alloys can be employed include, among others, sporting goods including baseball and soft ball bats, golf shafts, lacrosse sticks, tennis rackets, and arrows; and aerospace application including aerospace components such as wing plates, bulkheads, fuselage stringers, and structural extrusions and forgings; and ordnance parts such as sabots and missile launchers.

BRIEF DESCRIPTION OF THE DRAWINGS

The features and advantages of the present invention will become apparent form the following detailed description of a preferred embodiment thereof, taken in conjunction with the accompanying drawings, in which:

FIG. 1 is a graph depicting T6 strength (YTS and UTS) as a function of the total alloy content in weight percent for a number of sample alloys formed in accordance with the preferred embodiments;

FIG. 2 is a graph depicting fracture toughness as a function of combined percentages of Cu and Mg for sample alloys formed in accordance with the preferred embodiments;

FIG. 3 is an equilibrium diagram which depicts the phase relationships at 885° F. as a function of percentages of Cu and Mg for an alloy formed in accordance with the preferred embodiments that contains 9% Zn;

FIG. 4 is a graph illustrating the effect of the ratio of Mg to Cu on fracture toughness for the alloys formed in accordance with the preferred embodiments;

FIG. 5 is a graph depicting second phase volume percent as a function of heating rate in a formation process for Alloy AA7068;

FIG. 6 is a graph illustrating the effect of scandium on strength of an Al-8% Zn-2.2% Mg-1.9% Cu alloy;

DETAILED DESCRIPTION OF THE PREFERRED EMBODIMENTS

Figure 7:
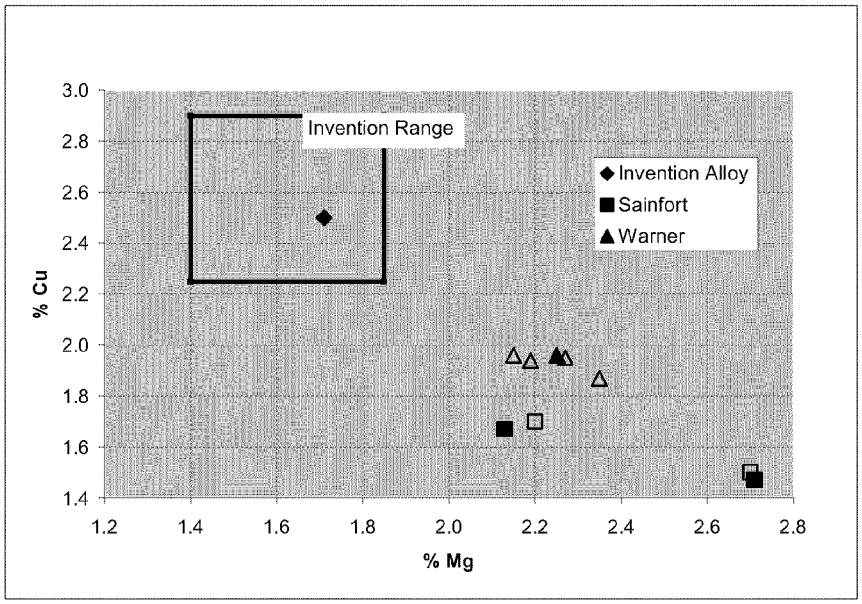
FIG. 7 is a graph showing the composition of the prior art (open symbols) and Example Alloy (solid symbols) in accordance with a preferred embodiment of the present invention.

The following examples illustrate how alloy modifications and efficient processing operations can be used to enhance the properties of the Al—Zn—Mg—Cu alloy system in accordance with the preferred embodiments of the present invention, such that they can be more effectively utilized in sporting goods and aerospace applications.

Example 1

A heretofore unexplored region of the Al—Zn—Mg—Cu alloy system consists of compositions comprising about 9% to 10% zinc, 2.2% to 2.8% copper, and 1.6% to 2.0% magnesium. The alloy compositions listed in Table 1 were cast as 9-in. diameter billets: note that all these alloys contain about 0.05% scandium, an element which in combination with zirconium is effective in preventing recrystallization.

TABLE 1

Alloy compositions

| | Percent by Weight | | | | | | |
|---|---|---|---|---|---|---|---|
| Alloy | Si | Fe | Cu | Mg | Zn | Zr | Sc |
| 179 | 0.04 | 0.07 | 2.47 | 1.83 | 8.87 | 0.14 | 0.06 |
| 180 | 0.04 | 0.09 | 2.71 | 1.89 | 8.95 | 0.13 | 0.06 |
| 189 | 0.04 | 0.08 | 2.14 | 1.89 | 8.60 | 0.12 | 0.05 |
| 190 | 0.03 | 0.09 | 2.31 | 1.86 | 9.21 | 0.13 | 0.05 |
| 191 | 0.03 | 0.11 | 2.35 | 1.81 | 9.63 | 0.13 | 0.05 |
| 192 | 0.04 | 0.10 | 2.33 | 1.87 | 10.13 | 0.12 | 0.05 |
| 200 | 0.04 | 0.09 | 2.58 | 1.64 | 8.84 | 0.12 | 0.05 |
| 202 | 0.04 | 0.12 | 2.46 | 1.66 | 8.87 | 0.13 | 0.05 |
| 203 | 0.04 | 0.10 | 2.69 | 1.78 | 8.94 | 0.13 | 0.05 |
| 204 | 0.03 | 0.10 | 2.88 | 1.58 | 8.78 | 0.12 | 0.05 |
| 209 | 0.04 | 0.08 | 2.64 | 1.49 | 8.78 | 0.14 | 0.05 |
| 213 | 0.03 | 0.07 | 2.42 | 1.63 | 9.65 | 0.13 | 0.05 |
| 214 | 0.03 | 0.09 | 2.56 | 1.44 | 9.50 | 0.14 | 0.05 |
| 215 | 0.04 | 0.09 | 2.57 | 1.73 | 9.82 | 0.12 | 0.05 |
| 216 | 0.03 | 0.10 | 2.81 | 1.60 | 9.65 | 0.13 | 0.05 |

The billets were homogenized at 880 F. (F means degrees Fahrenheit) and extruded to seamless 4-in. diameter tubes with a 0.305 in. wall thickness. The extrusions were solution heat treated at 880 F., quenched in cold water and "peak" aged to the T6 temper (24-hr soak at 250 F.). They were tested for tensile properties in the longitudinal direction and sections from all of the extrusions were cut and flattened to pieces about 12" square, which were also solution heat treated at 880 F., quenched in cold water and peak aged. These flattened sections were tested for fracture toughness (ASTM B645) in the T-L orientation. The tensile and fracture toughness properties are listed in Table 2.

TABLE 2

Tensile and fracture toughness properties

| | | % | Strength (ksi) | | Toughness (ksi rt. in) | |
|---|---|---|---|---|---|---|
| % Zn | % Cu | Mg | UTS | YTS | Kq | Kp |
| 8.60 | 2.14 | 1.89 | 97.1 | 88.5 | 25.2 | 30.5 |
| 9.21 | 2.31 | 1.86 | 100.1 | 93.9 | 22.4 | 27.5 |
| 9.63 | 2.35 | 1.81 | 99.9 | 94.2 | 20.9 | 25.4 |
| 10.13 | 2.33 | 1.87 | 103.2 | 97.8 | 21.2 | 24.0 |
| 8.87 | 2.47 | 1.83 | 101.1 | 92.2 | 20.9 | 23.9 |
| 8.95 | 2.71 | 1.89 | 102.9 | 93.7 | 20.1 | 20.5 |
| 8.84 | 2.58 | 1.64 | 98.6 | 93.8 | 23.1 | 25.8 |
| 8.87 | 2.46 | 1.66 | 98.4 | 92.8 | 25.3 | 22.2 |
| 8.94 | 2.69 | 1.78 | 100.0 | 94.2 | 24.2 | 22.4 |
| 8.78 | 2.88 | 1.58 | 99.1 | 93.8 | 24.8 | 21.9 |
| 8.78 | 2.64 | 1.49 | 96.4 | 91.9 | 24.8 | 22.9 |
| 9.65 | 2.42 | 1.63 | 100.3 | 96.3 | 24.7 | 21.3 |
| 9.50 | 2.56 | 1.44 | 98.5 | 94.9 | 26.2 | 21.2 |
| 9.82 | 2.57 | 1.73 | 102.6 | 98.2 | 21.9 | 18.2 |
| 9.65 | 2.81 | 1.60 | 100.6 | 97.1 | 20.0 | 18.4 |

As can be seen from Table 2, tensile yield strengths well in excess of 90 ksi were obtained in most of the alloys, with two compositions achieving about 98 ksi. As shown in FIG. 1, strength correlated well with the total alloy content, with each wt. pct. adding about 4.8 ksi to the yield strength. The equilibrium phase relations at the homogenizing and solution heat treatment temperature explain the reason for this behavior. FIG. 3 shows how the compositions listed in Table 1 relate to the magnesium and copper solubility limits at 885 F for alloys containing a nominal zinc level of 9%. Compositions lying below the demarcation line between the solid solution and the Al+S phase regions (i.e., the solvus) are single phase alloys, which have superior fracture toughness values for a given strength level, compared to those in the 2-phase region. The best combinations of strength and toughness are associated with alloys near the solvus line, which is why the 2.7% Cu/1.9% Mg composition has a relatively low toughness level. The preferred compositions therefore lie within the dashed lines that run approximately parallel to the solvus. These relationships are defined by controlling the total copper plus magnesium concentrations between 4.1% and 4.5%.

Although the properties described above were obtained with a "standard" T6 temper aging treatment by exposing the shaped products to heat of between 175 and 310 F. for 3 to 30 hours (24 hr at 250 F. was specifically used), as with most Al—Zn—Mg—Cu alloys, other practices may also be advantageous, depending on the desired combination of properties. For example, a tube from composition #213, when drawn to a tube 2.625" in diameter with a 0.110" wall thickness and aged by a 2-step practice of 8 hr at 250 F. plus 4 hr at 305 F. had yield and tensile strengths of 100.9 ksi and 102.6 ksi, respectively. Similarly, the subject alloy can be over aged beyond peak strength in a second step at temperatures in the 310-360 F. temperature range for 2 to 24 hours to provide a desirable combination of strength and corrosion resistance. Another preferred embodiment includes a final aging treatment in a third step at a lower temperature in the range 175-300 F. for 1 to 30 hours, which provides an additional strength benefit with no loss in corrosion properties. As yet another alternative, the alloy can be subjected only to the aforementioned second and third aging steps by skipping the first step.

Example 2

To compare the invention alloy with other commercial high-zinc alloys such as AA7036, AA7056 and AA7449, which have higher Mg/Cu ratios in the range 1.0 to 1.4, the following alloys were prepared as described in Example 1.

TABLE 3

Compositions of Comparative Alloys

| | Percent by Weight | | | | | | |
|---|---|---|---|---|---|---|---|
| Alloy No. | Si | Fe | Cu | Mg | Zn | Zr | Sc |
| 36 | 0.03 | 0.06 | 1.91 | 2.17 | 9.02 | 0.15 | 0.05 |
| 39 | 0.04 | 0.05 | 1.28 | 2.74 | 9.02 | 0.13 | 0.06 |
| 43 | 0.03 | 0.03 | 1.44 | 2.62 | 9.04 | 0.13 | 0.05 |
| 47 | 0.04 | 0.06 | 1.59 | 2.34 | 8.95 | 0.14 | 0.06 |

The yield strengths and toughness values for these alloys are listed in the following table.

TABLE 4

Mechanical Properties of Comparative Alloys

| Alloy | Mg/Cu Ratio | % (Mg + Cu) | Yield Strength (ksi) | Kpmax (ksi rtin.) |
|---|---|---|---|---|
| 36 | 1.14 | 4.08 | 94.9 | 24.5 |
| 47 | 1.47 | 3.93 | 93.9 | 22.7 |
| 43 | 1.77 | 3.99 | 93.9 | 21.3 |
| 39 | 2.14 | 4.02 | 92.7 | 20.2 |

FIG. 4 compares the toughness levels of these alloys on the basis of Mg/Cu ratio with the invention alloys, using those compositions that have similar strength levels (93-95 ksi) and total Mg+Cu contents (4.0-4.2%).

Example 3

As noted earlier it is important that undissolved second phases do not remain after processing so that fracture toughness can be maximized. This is especially important in alloys that are rich in alloy content, and lie near an equilibrium solvus phase boundary. To illustrate how homogenizing practice can affect the amount of such undissolved phase(s), samples of as-cast AA7068 alloy billet were heated from 850 F. at various rates in a differential scanning calorimeter (DSC), and the energy associated with eutectic melting, which started at about 885 F. was measured. This energy measurement is directly proportional to the amount of undissolved second phase remaining at the incipient melting point, and the relationship between these factors has been determined by quantitative microscopy. FIG. 5 shows how heating rate affects the amount of this phase as determined from the DSC data.

Note that a slow heating rate of about 10 F./hr reduces the amount of second phase to a level below 1 vol. %. One would expect that a .about.5 F/hr heating rate would reduce the "soluble" portion to near zero. We also note that for heating rates of 10-20 F./hr, the volume fraction of undissolved eutectic is no greater than the amount of insoluble Fe-containing constituent (independent of heating rate or homogenization temperature) at a nominal 0.12% Fe level (approx. 1 vol. %).

Example 4

It has been recognized for a number of years that scandium in combination with zirconium is an effective recrystallization inhibitor. A Russian review article states "it is desirable to add scandium to aluminum alloys in a quantity from 0.1 to 0.3% together with zirconium (0.05-0.15%)". However, "the greatest effect . . . is observed for alloys not containing alloy elements combining with scandium in insoluble phases . . . ; with a limited copper content [scandium combines with copper] alloying with scandium together with zirconium of Al—Zn—Mg—Cu and Al—Cu—Li alloys is possible". As such, "commercial alloys based on Al—Zn—Mg—Sc—Zr (01970, 01975) have been developed".

Two potential drawbacks to scandium additions to 7XXX alloys containing about 2% copper are evident:

1) the copper level is high enough to combine with scandium, thereby rendering it ineffective, and 2) the high price of scandium; at the 0.2% level it would add about $10 a pound to the cost of the aluminum alloy.

It would therefore be economically and technically attractive if scandium levels could be effectively used below those recommended in the Russian literature.

Alloys of the compositions listed in the following table were prepared as 5" diameter billets, which were processed as described below. Although the sample alloys contained more Mg and less Cu than the preferred alloys discussed previously, it is believed that the effect of Sc addition to the alloys would be essentially the same for the preferred alloys.

TABLE 5

| Alloy | % by wt. | | | | | | |
|---|---|---|---|---|---|---|---|
| No. | Si | Fe | Cu | Mg | Zn | Zr | Sc |
| A | 0.03 | 0.04 | 1.95 | 2.20 | 8.07 | 0.11 | 0.00 |
| B | 0.03 | 0.05 | 1.86 | 2.17 | 8.05 | 0.00 | 0.22 |
| C | 0.03 | 0.05 | 1.89 | 2.18 | 8.09 | 0.11 | 0.06 |
| D | 0.03 | 0.04 | 1.84 | 2.12 | 8.11 | 0.12 | 0.11 |
| E | 0.03 | 0.05 | 1.95 | 2.18 | 8.08 | 0.11 | 0.22 |

The ingots were homogenized at 875 F. using a 50 F./hr heating rate and air cool, and then reheated to 800 F. and extruded to a 0.25" by 3" flat bar. Sections of each extrusion were annealed at 775 F. for 3 hr, cooled 50 F./hr to 450 F., held 4 hr and cooled 50 F./hr to room temperature. The sections were then cold rolled to 0.040" sheet using five pass reductions (84% total reduction). The sheets were solution heat treated at 885 F. for 30 min, quenched in cold water, and then aged to the peak strength condition (10 hr at 305 F.). The as-extruded bars were also heat treated similarly and both products were tested for transverse tensile properties, as listed below. The specific effects of scandium on strength are also shown in FIG. 6.

TABLE 6

| | | | UTS (ksi) | | Yield Strength (ksi) | |
|---|---|---|---|---|---|---|
| Alloy No. | % Zr | % Sc | Extrusion | Sheet | Extrusion | Sheet |
| A | 0.11 | 0 | 94.7 | 90.7 | 91.4 | 87.8 |
| B | 0 | 0.22 | 88.2 | 92.0 | 86.1 | 88.4 |
| C | 0.11 | 0.06 | 95.7 | 97.1 | 92.2 | 93.3 |
| D | 0.12 | 0.11 | 95.2 | 96.6 | 92.2 | 93.3 |
| E | 0.11 | 0.22 | 94.5 | 96.5 | 91.1 | 92.5 |

A number of points are evident from these results: [0036] 1. The strongest alloy in both extrusion and sheet form contains 0.06% Sc (with 0.11% Zr) [0037] 2. At the 0.1% Zr level, 0.06% Sc is effective in raising the strength of the sheet product by about 6 ksi. [0038] 3. 0.22% Sc in the absence of zirconium raises the strength of the sheet product by only 1 ksi, and lowers the extrusion strength by about 6 ksi. The effectiveness of only 0.06% Sc in preventing recrystallization was confirmed by comparing the microstructures of the sheet products containing (a) 0.11% Zr, (b) 0.11% Zr+0.06% Sc, and (c) 0.22% Sc (no Zr). In view of the foregoing, the preferred range in the alloys for Sc is 0.05-0.30%, with a more preferred range of 0.05-0.10%.

Example 5

TABLE 7 lists the alloys provided in Warner (U.S. Published application 2002-0162609) and Sainfort (U.S. Pat. No. 5,560,789).

TABLE 7

| Alloy | Cu | Mg | Zn | Cr | Zr |
|---|---|---|---|---|---|
| Warner 1 | 1.94 | 2.19 | 8.11 | 0.06 | 0.09 |
| Warner 2 | 1.96 | 2.15 | 8.38 | 0 | 0.11 |
| Warner A | 1.87 | 2.35 | 8.38 | 0 | 0.11 |
| Warner B | 1.95 | 2.27 | 8.31 | 0 | 0.10 |
| Sainfort 1 | 1.70 | 2.20 | 8.30 | 0.20 | 0 |
| Sainfort 2 | 1.50 | 2.70 | 7.70 | 0.20 | 0 |

The Warner alloys fall within AA7349/7449 limits; the Sainfort compositions are more typical of AA7049/7149. To compare the invention composition with these alloys, the compositions provided in TABLE 8 were cast as 3-inch thick by 9-inch wide ingots.

TABLE 8

| Compositions of 3" × 9" Ingots | | | | | |
|---|---|---|---|---|---|
| Alloy | Cu | Mg | Zn | Cr | Zr |
| Warner | 1.96 | 2.25 | 8.26 | 0 | 0.12 |
| Sainfort 1 | 1.67 | 2.13 | 8.16 | 0.19 | 0 |
| Sainfort 2 | 1.47 | 2.71 | 7.69 | 0.20 | 0 |
| Invention | 2.50 | 1.71 | 9.05 | 0 | 0.12 |

All the compositions are shown in FIG. 7, where the open and closed symbols identify prior art (Table 7) and example (Table 8) alloys. FIG. 7 demonstrates that the comparative example alloys are well representative of the prior art compositions. Impurity levels in the example alloys were about 0.02% Si and 0.06-0.09% Fe.

The ingots were homogenized for 4 hr at 850 F plus 16 hr at 880 F with heating rates of 50 F/hr from about 700 F to 850 F and 20 F/hr from 850 F to 880 F. The homogenized ingots were reheated to 775 F and hot rolled to 0.180-in sheet. They were then cold rolled to a nominal gage of 0.093 in., annealed at 750 F for 4 hours (~50 F/hr heating and cooling rates), solution heat treated at about 880 F for 30 minutes and quenched in room temperature water. The sheets were step-1 aged for 24 hr at 250 F and samples of each were step-2 aged at 320 F for 4 to 12 hr. Based on transverse tensile property data, conditions were selected for an assessment of toughness at comparable yield strengths, using duplicate T-L Kahn tear specimens (ASTM B871).

The tensile and Kahn tear properties are listed in Table 9 below.

TABLE 9

| Alloy | Aging Time (hr) | Yield Strength (ksi) | Propagation Energy (in-lb/in$^2$) | Total Energy (in-lb/in$^2$) |
|---|---|---|---|---|
| Warner | 8 | 85.5 | 0, 0 | 128, 155 |
| | 12 | 82.5 | 114, 117 | 257, 299 |
| Sainfort | 4 | 79.8 | 144, 191 | 358, 424 |
| 1 | 12 | 74.7 | 296, 327 | 636, 643 |
| Sainfort | 8 | 78.9 | 105, 112 | 238, 246 |
| 2 | 12 | 77.5 | 106, 128 | 258, 264 |
| Inven- | 4 | 84.2 | 130, 134 | 315, 328 |
| tion | 8 | 81.4 | 191, 248 | 465, 478 |
| | 12 | 76.6 | 343, 420 | 710, 807 |

Figure 8:
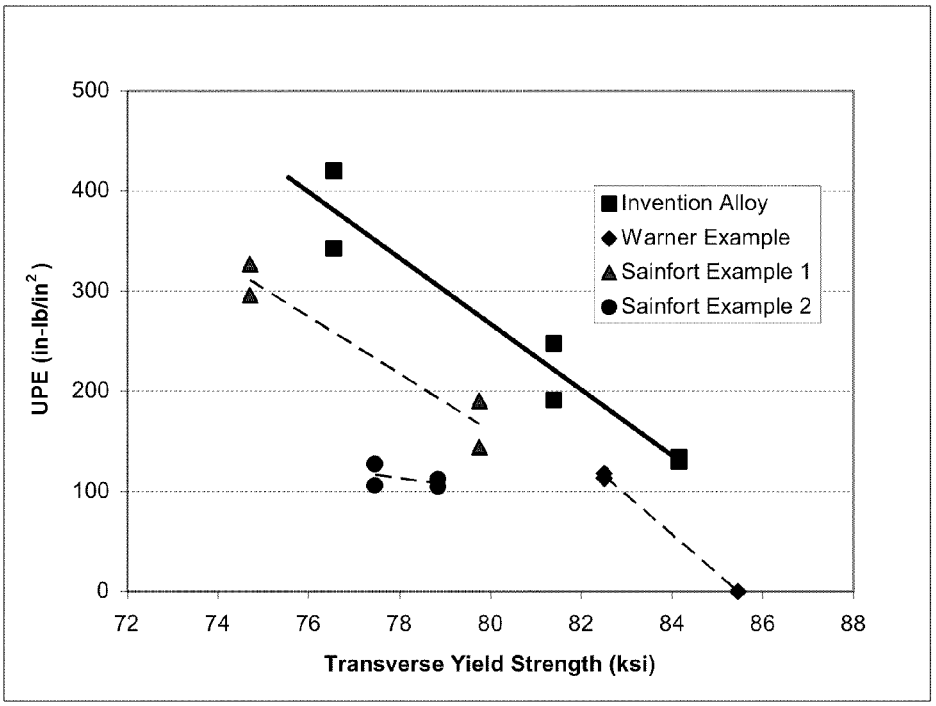
FIG. 8 is a graph showing the unit propagation energy (UPE) vs. Sheet Yield strength of the Invention Alloy and the prior art examples.
Figure 9:
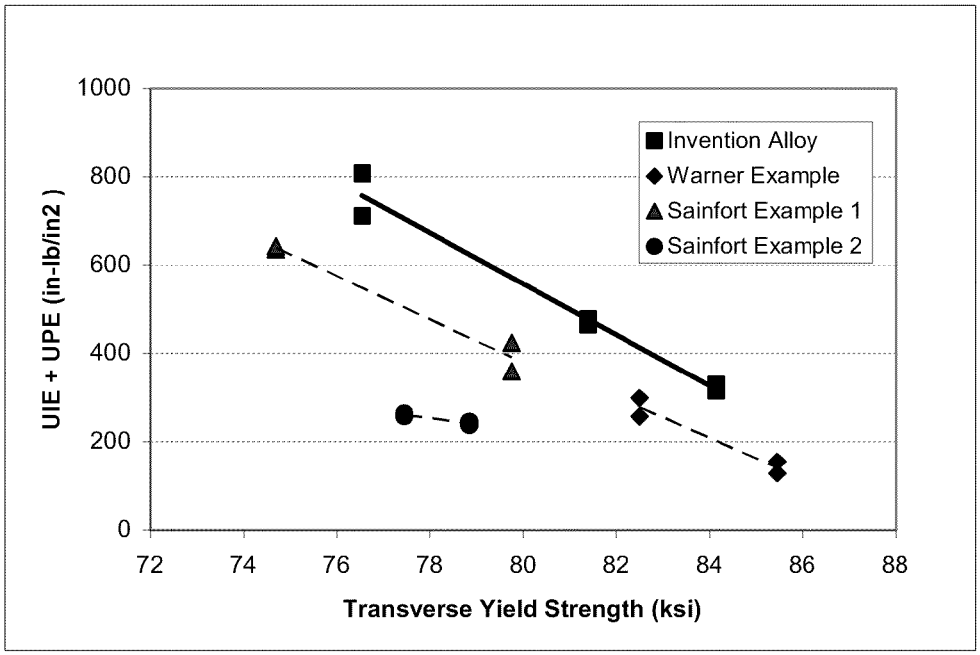
FIG. 9 is a graph showing the total Kahn Tear Energy vs. Yield Strength of the Invention Alloy and the prior art examples.

The Kahn tear results are plotted against yield strength in FIGS. 7 and 8, which show that the invention alloy has a superior combination of strength and toughness than the cited example compositions, i.e., higher toughness for a given yield strength.

Although the present invention has been described in terms of a number of preferred embodiments and variations thereon, it will be understood that numerous additional variations and modifications may be made without departing from the scope of the invention. Thus, it is to be understood that within the scope of the appended claims, the invention may be practiced otherwise than as specifically described above.

We claim:

1. An aluminum alloy product having high strength with good toughness, containing by weight, 8.5-10.5% Zn, 1.4-1.85% Mg, 2.25-3.0% Cu, and at least one element from the group Zr, V, or Hf not exceeding about 0.5%, wherein said alloy includes Mg and Cu at a Mg/Cu ratio of less than 1.0, the balance substantially aluminum and incidental impurities with fracture toughness (as measured in unit propagation energy) exceeding the following relationship:

$$UPE \geq -32.894(YS)+2861$$

where UPE=fracture toughness as measured in unit propagation energy (#/in$^2$)

YS=yield strength (KSI).

2. The alloy product of claim 1, wherein said alloy contains about 0.05-0.2% Zr.

3. The alloy product of claim 1, wherein said alloy includes 0.05-0.30% Sc.

4. The alloy product of claim 3, wherein said alloy includes 0.05-0.20% Zr.

5. The alloy product of claim 1, wherein said alloy includes about 0.03-0.10% Si and 0.03-0.12% Fe.

6. The alloy product of claim 1, wherein the combined weight percentages of Mg and Cu range from 4.0 to 4.4%.

7. The alloy product of claim 6, wherein the combined weight percentages of Zn, Mg and Cu range from 13.0 to 14.5%.

8. The alloy product of claim 1, wherein said product is selected from the group including sporting goods such as baseball and soft ball bats, golf shafts, lacrosse sticks, tennis rackets, and arrows; aerospace components such as wing plates, bulkheads, fuselage stringers, and structural extrusions and forgings; and ordnance parts such as sabots and missile launchers.

9. The alloy product of claim 1, wherein said alloy includes Mg and Cu at a Mg/Cu ratio of ≤0.8.

10. An aluminum alloy product having high strength with good toughness, containing by weight, 8.5-10.5% Zn, 1.4-1.75% Mg, 2.25-3.0% Cu, and at least one element from the group Zr, V, or Hf not exceeding about 0.5%, wherein said alloy includes Mg and Cu at a Mg/Cu ratio of less than 1.0, the balance substantially aluminum and incidental impurities with fracture toughness (as measured in unit propagation energy) exceeding the following relationship:

$$UPE \geq -32.894(YS)+2861$$

where UPE=fracture toughness as measured in unit propagation energy (#/in$^2$)

YS=yield strength (KSI).

11. The alloy product of claim 10, wherein said alloy contains about 0.05-0.2% Zr.

12. The alloy product of claim 10, wherein said alloy includes 0.05-0.30% Sc.

13. The alloy product of claim 12, wherein said alloy includes 0.05-0.20% Zr.

14. The alloy product of claim 10, wherein said alloy includes about 0.03-0.10% Si and 0.03-0.12% Fe.

15. The alloy product of claim 10, wherein the combined weight percentages of Mg and Cu range from 4.0 to 4.4%.

16. The alloy product of claim 15, wherein the combined weight percentages of Zn, Mg and Cu range from 13.0 to 14.5%.

17. The alloy product of claim 1, wherein said product is selected from the group including sporting goods such as baseball and soft ball bats, golf shafts, lacrosse sticks, tennis rackets, and arrows; aerospace components such as wing plates, bulkheads, fuselage stringers, and structural extrusions and forgings; and ordnance parts such as sabots and missile launchers.

18. The alloy product of claim 10, wherein said alloy includes Mg and Cu at a Mg/Cu ratio of ≥0.8.

19. The alloy product of claim 10, wherein said alloy includes 0.06-0.09% Fe.

20. The alloy product of claim 10, wherein said alloy includes 9-10.5% Zn.

* * * * *